US006101681A

United States Patent [19]

Patelli et al.

[11] Patent Number: 6,101,681

[45] Date of Patent: Aug. 15, 2000

[54] FIXED AND ADJUSTABLE CARDING ELEMENT FOR TEXTILE MATERIAL OPENING OR CARDING MACHINES

[75] Inventors: Silvano Patelli; Marco Facchinetti; Giovanni Battista Pasini, all of Palazzolo Sull'Oglio, Italy

[73] Assignee: Marzoli S.p.A., Italy

[21] Appl. No.: 09/274,679

[22] Filed: Mar. 24, 1999

[30] Foreign Application Priority Data

Mar. 24, 1998 [IT] Italy ..... MI98A0597

[51] Int. Cl.[7] ..... D01G 15/02

[52] U.S. Cl. ..... 19/104; 19/98; 19/113

[58] Field of Search ..... 19/98, 99, 100, 19/104, 105, 110, 113, 114

[56] References Cited

U.S. PATENT DOCUMENTS

| | | | |
|---|---|---|---|
| 4,074,392 | 2/1978 | Bechtel, Jr. | 19/113 |
| 4,221,023 | 9/1980 | Henderson et al. | 19/113 |
| 4,471,607 | 9/1984 | Schmolke | 19/105 |
| 4,974,295 | 12/1990 | Demuth et al. | 19/113 |

*Primary Examiner*—John J. Calvert
*Assistant Examiner*—Gary L. Welch
*Attorney, Agent, or Firm*—Kramer Levin Naftalis & Frankel

[57] ABSTRACT

Fixed adjustable carding element for textile fibre carding and opening machines consisting of a support structure which contains and guides in the radial direction a movable element which supports the carding clothing.

19 Claims, 3 Drawing Sheets

Figure 1:
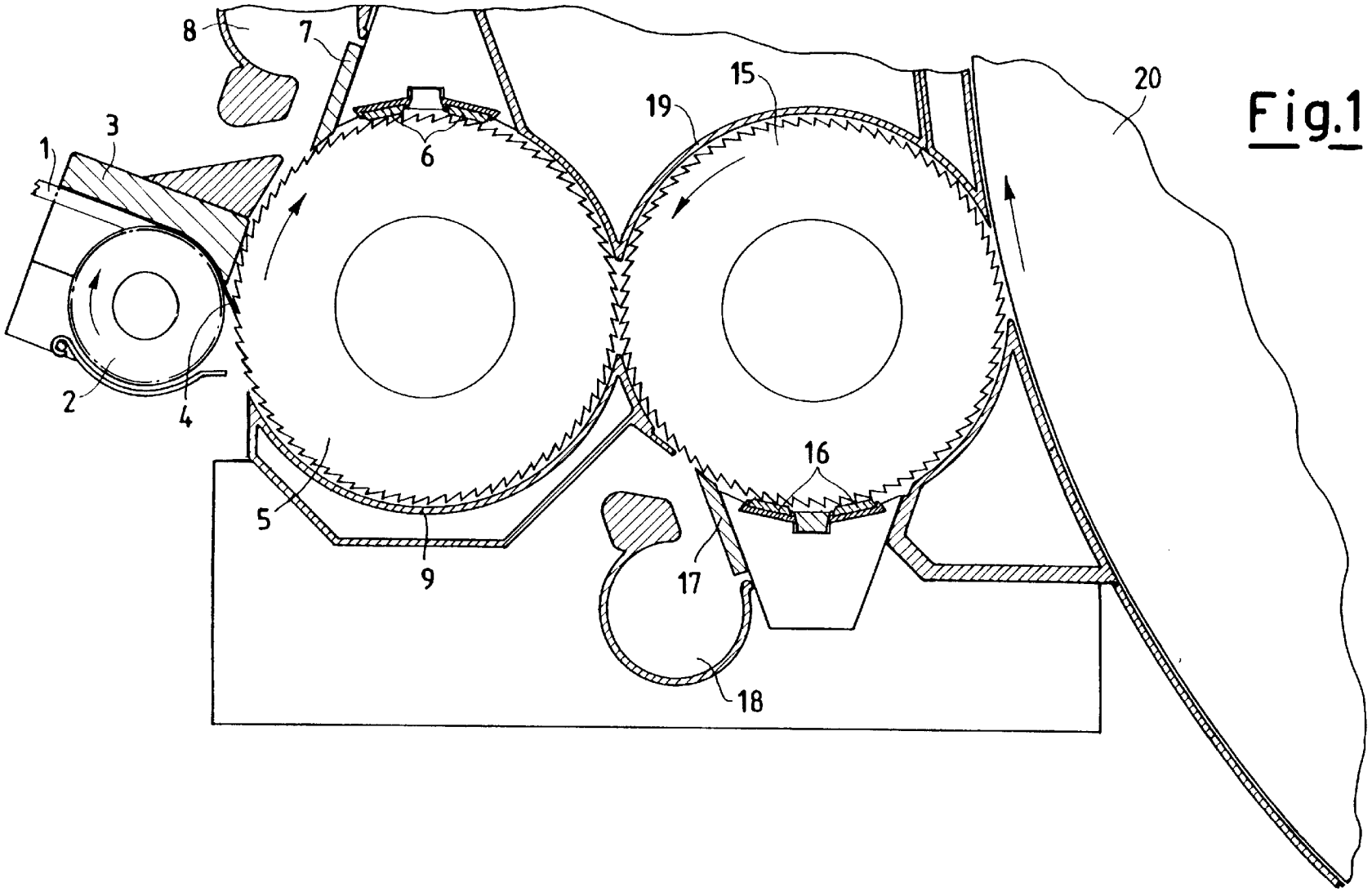

FIXED AND ADJUSTABLE CARDING ELEMENT FOR TEXTILE MATERIAL OPENING OR CARDING MACHINES

The invention relates to the opening and carding of fibrous material, such as cotton or other textile fibres, in which it is processed in a thin layer by a series of surfaces equipped with a multiplicity of wires of different shape, inclination and rigidity and actuated by relative motion with respect to each other, in which the fibrous material is opened in the form of a single fibre, the smallest waste particles are eliminated—like the waste and entanglements or neps—the fibres are mixed together and a sliver of untwisted fibres is formed, to be sent on to the subsequent processing stages until the yarn is obtained.

To illustrate the features and advantages of the present invention it will be described with reference to its application to the flat carder and in particular the first processing part, by way of non-exhaustive example. The invention may in fact also be applied in various machines which prepare fibres for spinning, such as horizontal openers.

In its most general aspects the carding operation comprises the following main stages, illustrated with reference to FIG. 1.

The raw material 1 consisting of staple fibres gathered in the form of a pad is fed to the machine by a feed roller 2 which presses it and controls it against the slab 3 and supplies a pencil 4 thereof to the opening roller 5, commonly known as the "licker-in".

The function of the licker-in, generally one or two rollers in series in terms of numbers, is to effect the first opening and cleaning of the fibrous material fed to the carder. Generally speaking the opening roller or licker-in is equipped with a clothing, or with wires inclined in the direction of rotation and operates at a considerable rotational speed. The pencil 4 of fibres is thus coarsely combed and distributed on the opening roller according to a layer thinner than the original one of the pad 1. Along its clockwise rotation the layer of fibres encounters one or more fixed carding elements consisting of clothed segments 6 and knives 7 for removing impurities. These impurities are extracted with extracting openings 8 located in correspondence with the face of the knife 7 which is external to the licker-in 5. These fixed carding elements must be mounted with accurate positioning with respect to the clothing of the wires of the licker-in roller, as a function of the nature and conditions of the fibres being processed.

The embodiment of FIG. 1 shows a second opening roller or licker-in 15, also equipped with a clothing and operating at a considerable rotational speed. Its peripheral speed is substantially greater than that of the first roller and the wires of its clothing remove the fibres from the first licker-in.

On the second licker-in the fibres are already more clean and extended: they are further combed and distributed on the second opening roller according to a layer which is thinner than that on the licker-in 5. Along its anti-clockwise rotation the layer of fibres encounters other fixed carding elements, also consisting of clothed segments 16, knives 17 and extracting openings 18, all similar to those of the first licker-in. In the remaining parts of their circumference the two lickers-in 5 and 15 are surrounded by containment plates 9 and 19 which hold back the fibres adhering to their clothings apart from in the points where they are worked with the elements described and in the feed and discharge points. The second licker-in thus gives up the fibres to the subsequent main carding roller 20.

Fixed carding elements and movable flats, which are not shown in the drawing for reasons of simplicity, are arranged round the circumference of the roller 20. In particular, these fixed elements also may be produced with the devices according to the invention. These fixed carding elements and flats cooperate with the clothing of the roller to card the fibres fed by the lickers-in 5 and 15 which are processed on the carder roller and are then removed from the carder by discharge and detachment rollers which are also not shown in the drawing for reasons of simplicity.

The present invention refers more particularly to a fixed carding element of novel design to obtain a processing of the fibrous material of high efficiency and improved quality. The fixed carding elements, and particularly those installed along the surfaces of the lickers-in, are there to process a material which still contains a significant quantity of impurities such as husks, small pieces of wood, lumps, dust and neps of fibres which are not retained by the carding clothing. It should also be borne in mind that the fibrous material supplied with the pad 1 is not of constant density so that, particularly on the lickers-in 5 and 15 located at the start of the machine, the thickness and density of the layer of fibres are subject to variations which are equalized along the path of the carder but may be sudden on the initial lickers-in. The radial control of the fixed carding elements must also take account of this possible irregularity in the output of fibres onto the lickers-in. These circumstances are therefore restrictive of the efficiency of the extending and cleaning of the fibrous layer being processed.

To keep both the efficiency of the carder and the quality of the product high, frequent stoppages of the flat carder are therefore required, to adjust the position of the fixed elements frequently and to clean the clothings of the rotating licker-in and of the fixed carding elements, which have to be dismantled and refitted accurately.

The fixed carding element according to the invention is defined, in its broadest sense, in claim 1 while the dependent claims define its preferred embodiments. To illustrate the features and advantages of the invention more clearly it will be described with reference to a typical embodiment shown in FIGS. 2 and 3, by way of non-exhaustive example, by the fixed carding element of the second licker-in of FIG. 1 which may, however, also be referred to the first licker-in 5. According to the embodiment of FIG. 2 the fixed carding element according to the invention consists of a support structure 30 in the form of a bar of trapezoidal section which extends in axial direction along the generatrix of the opening roller 15. The right-hand face of the structure 30 is equipped with bores 31 with a threaded seating for fixing the carding element to the frame of the carder, and the left-hand face is equipped with bores 32 with a threaded seating for fixing and adjusting the knife 17, with screws 33 for example.

In the body of the structure of trapezoidal section 30 and in the base adjacent to the surface of the roller 15 there is a cavity 35 in the form of a parallelepiped which extends axially over the entire clothed generatrix of the roller 15 and is intended to contain a movable element 40 to support the clothing 16 opposite the surface of the roller 15. Guide surfaces 36 are produced in the cavity 35, for the radial movement of the movable element 40 which has homologous guide surfaces 41 which engage therewith and prevent them from sliding in axial or tangential direction. In the body of the support 30 and on the bottom of the parallelepiped cavity 35 there is a series of through bores 37 as far as the face opposite the roller 15.

The movable element 40 comprises a face 42, to be presented to the roller 15, onto which the carding clothing 16 is fixed in per se known manner. A series of threaded bars is mounted in the opposite face: for example, a series of threaded bores 43 is produced, into which the threaded bars 44 are stably screwed. These threaded bars 44 are inserted into the through bores 37 and they extend radially beyond the face 38 of the structure 30. A washer 45 to rest on the face 38 is threaded onto the threaded stem of such bars and an adjusting nut 46 is screwed on; these determine the end-of-travel of the movable element 40 towards the roller 15 and thus operate as delimitation and constraint of the reciprocal radial movement between fixed structure with bars 30 and movable element 40. When the movable element 40 is mounted on the structure 30, a spring 47 which opposes the retraction movement of the element 40 inside the cavity 35 is interposed on the threaded bar 44.

Figure 2:
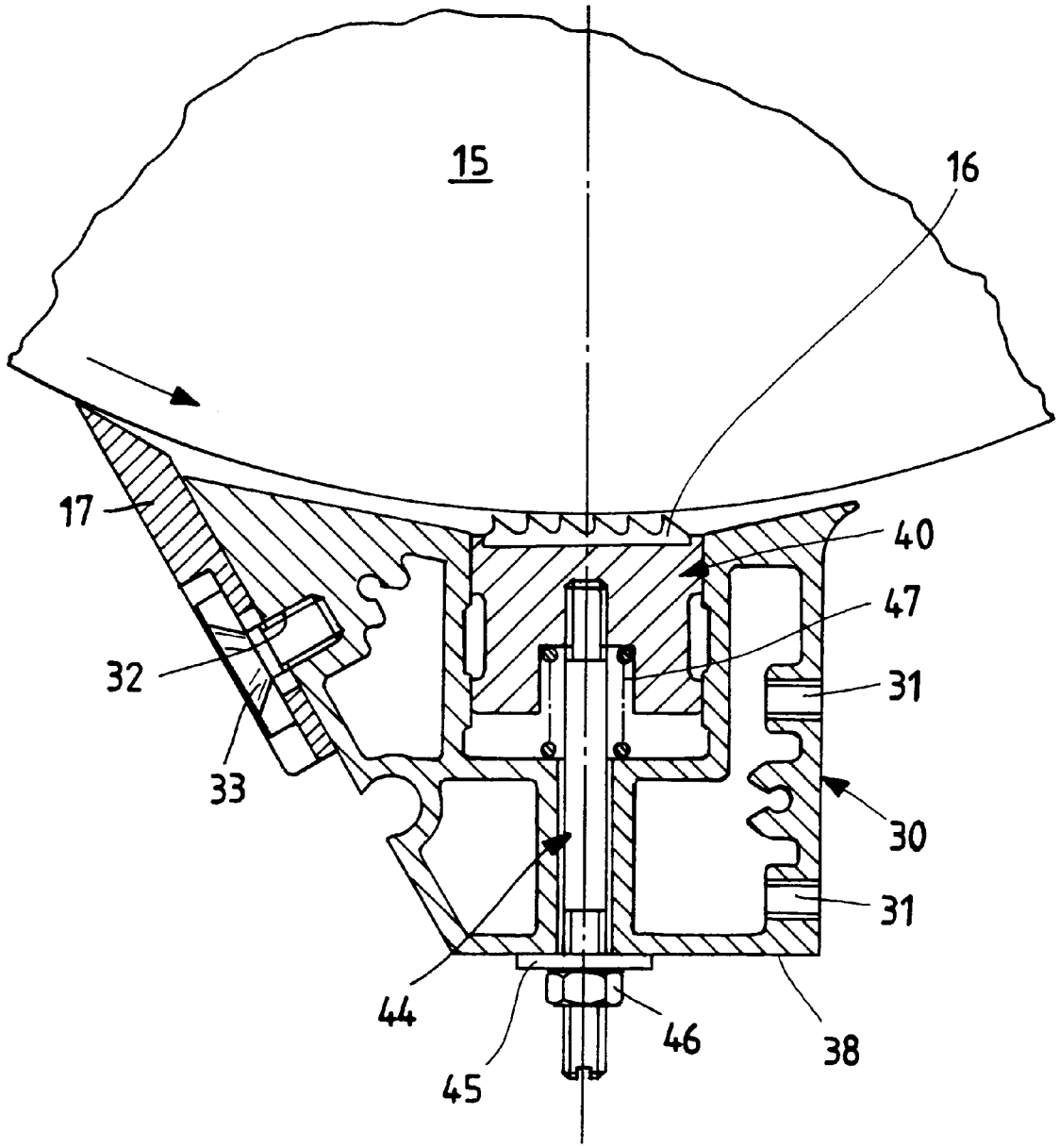
Figure 3:
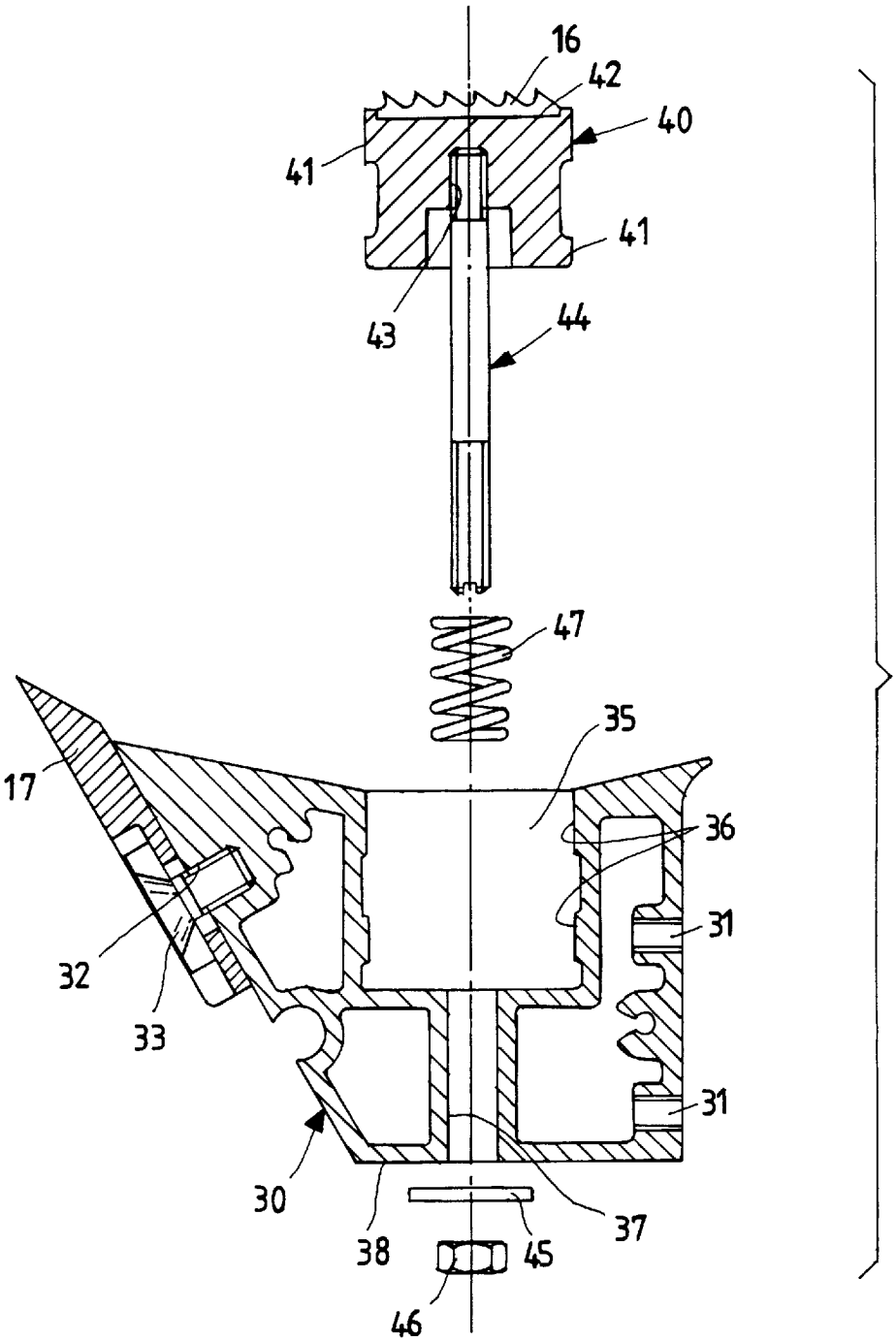

FIG. 3 shows an exploded view of the embodiment of FIG. 2, to show its component parts more clearly. It can be seen that the carding element according to the invention and shown in the embodiment in FIGS. 2 and 3 has very interesting operating features and offers substantial advantages. It has the feature of self-adjusting its radial distance with respect to the clothed surface of the opening roller according to the quality and quantity of fibres in the pad 1 fed moment by moment to the machine with the roller 2—slab 3 assembly. If a foreign body or an entanglement of fibres, which has passed under the knife 17 and moves towards the carding sector 16, arrives, it does not jam and does not obstruct the passage of the layer of fibres: the movable element 40 distances itself radially through the effect of its thrust and allows it to pass. All the movable equipment 40, with the threaded bar 44 and the nut 46, translates radially and compresses the spring 47; after this passage the spring extends and returns to position the element 40 with the bearing of the nut 46 underneath on the face 38 of the fixed structure 30 with the washer 45 interposed.

It may also be noted that the device according to the invention not only allows the radial distance of the sector 16 from the licker-in to be adjusted by acting on the nut 46 but it also enables the load on the clothing of the sector 16 deriving from the output of fibres transported by the licker-in clothing to be predetermined, by calibrating the pre-loading of the spring 47, or by from time to time adopting springs of different elastic properties, or by varying the number of springs interposed between fixed structure 30 and movable element 40. In place of the resisting spiral spring shown in the drawings, means with equivalent elastic properties such as flat springs, small pneumatic balls or cylinders and so on may be used for this interposition.

The device according to the invention affords its best service when used as fixed carding element in machines which prepare for spinning, where accurate and delicate staple pre-opening preparation is required, without increasing the percentage of neps or broken fibres already present. The fibres processed with the fixed carding elements according to the invention are in fact more regular and clean and do not require, in the subsequent carding rollers, the adoption of more aggressive metal clothings to which recourse would otherwise be required in order to open and completely extend the fibres of the staples. These aggressive clothings would in fact give rise to a significant increase in neps and broken fibres, with a consequent drop in yield and product quality.

The time intervals between the interventions required for cleaning the clothings and adjusting them are similarly prolonged.

What is claimed is:

1. A carding assembly for a textile carding machine comprising:

a fixed external support structure; and a moveable element, wherein the fixed external support structure includes a cavity forming an opening between the fixed external support structure and an axial surface of an opening roller, the moveable element being disposed in the cavity, the moveable element having a clothed carding segment with teeth disposed adjacent to the axial surface of the opening roller, a radial movement of the moveable element with respect to the axial surface of the opening roller being guided by the cavity, an axial motion and a tangential motion of the moveable element being substantially limited by the cavity wherein the movable element has a centeral bore on side opposite the teeth with an elastic element inserted in the bore.

2. The carding assembly of claim 1, wherein the opening extends along substantially an entire axial surface of the opening roller.

3. The carding assembly of claim 1, wherein the fixed external support structure comprises at least one through bore.

4. The carding assembly of claim 3, wherein a distal end of the moveable element includes a threaded bar inserted into the a through bore.

5. The carding assembly of claim 4, wherein the threaded bar comprises a bearing washer and an adjusting nut.

6. The carding assembly of claim 5, wherein the bearing washer and the adjustable nut limits an extent of the radial movement of the moveable element.

7. The carding assembly of claim 4, wherein the elastic element comprises a spring.

8. The carding assembly of claim 7, wherein the spring is a coiled spring and the threaded bar extends through the coils.

9. The carding assembly of claim 7, wherein the spring limits the radial movement of the moveable element.

10. The carding assembly of claim 4, wherein the central bore is threaded.

11. The carding assembly of claim 10, wherein the threaded bar is stably inserted into the threaded central bore.

12. The carding assembly of claim 1, wherein the cavity of fixed external support structure forms guides for controlling the axial movement of the moveable element.

13. The carding assembly of claim 12, wherein the moveable element includes guides for controlling the axial movement in cooperation with the guides of the fixed external support structure.

14. A carding assembly comprising:

a fixed support structure, an opening being disposed along an axial length of the support structure;

a moveable carding element disposed in the opening and adjustably connected to the fixed support structure, the moveable carding element being opposed to a clothing roller and the opening guiding radial movement of the moveable carding element as a function of a quantity and quality of fibers transported by the clothing roller;

at least one through bore extending through the fixed support structure; and at least one threaded bar inserted into the through bore, wherein the threaded bar comprises means for delimiting radial movement of the moveable carding element.

15. The carding assembly of claim 14, wherein the moveable element comprises a through bore into which the threaded bar is inserted.

16. The carding assembly of claim 14, wherein the means for delimiting radial movement of the moveable carding element comprises a washer and an adjusting nut.

17. The carding assembly of claim 14, wherein a spring is disposed on the threaded bar between the moveable element and a surface of the fixed support structure.

18. The carding assembly of claim 17, wherein the spring is a coiled spring and the threaded bar extends through the coils.

19. The carding assembly of claim 17, wherein the spring limits the radial movement of the moveable element.

* * * * *